US009218904B2

(12) United States Patent
Fabbro et al.

(10) Patent No.: US 9,218,904 B2
(45) **Date of Patent: *Dec. 22, 2015**

(54) REFRIGERATOR WITH CONTACTLESSLY POWERED MOVABLE MEMBER

(71) Applicant: Electrolux Home Products Corporation N.V., Brussels (BE)

(72) Inventors: Edi Fabbro, Bertiolo (IT); Giancarlo Arrigoni, Udine (IT); Dario Muzzolini, Magnano in Riviera (IT)

(73) Assignee: ELECTROLUX HOME PRODUCTS CORPORATION N.V., Zaventem (BE)

( * ) Notice: Subject to any disclaimer, the term of this patent is extended or adjusted under 35 U.S.C. 154(b) by 0 days.

This patent is subject to a terminal disclaimer.

(21) Appl. No.: 14/165,916

(22) Filed: Jan. 28, 2014

(65) Prior Publication Data

US 2014/0139040 A1 May 22, 2014

Related U.S. Application Data

(63) Continuation of application No. 12/065,194, filed as application No. PCT/EP2006/063337 on Jun. 20, 2006, now Pat. No. 8,657,392.

(30) Foreign Application Priority Data

Sep. 2, 2005 (EP) ..... 05108094

(51) Int. Cl.

| | |
|---|---|
| ***H01F 38/14*** | (2006.01) |
| ***F25D 23/00*** | (2006.01) |
| ***F25D 25/00*** | (2006.01) |
| *F21V 23/02* | (2006.01) |

(Continued)

(52) U.S. Cl.

CPC ..... *H01F 38/14* (2013.01); *F25D 23/00* (2013.01); *F25D 25/00* (2013.01); *F21V 23/02* (2013.01); *F21Y 2101/02* (2013.01); *F25D 27/00* (2013.01); *F25D 2400/40* (2013.01)

(58) Field of Classification Search

CPC ..... F25D 2400/40; F25D 27/00
USPC ..... 312/223.6, 405, 408; 336/212, 214, 336/215, 220, 221; 439/950

See application file for complete search history.

(56) References Cited

U.S. PATENT DOCUMENTS

| | | | | |
|---|---|---|---|---|
| 3,263,063 | A | 7/1966 | Marriott et al. | |
| 4,569,205 | A * | 2/1986 | Dempou et al. | 62/155 |

(Continued)

FOREIGN PATENT DOCUMENTS

| | | |
|---|---|---|
| FR | 2730852 | 8/1996 |
| JP | 406105724 | 4/1994 |

(Continued)

OTHER PUBLICATIONS

English translation of Kamo (JP2002320348), dated Sep. 2, 2014.*

*Primary Examiner* — Matthew Ing
(74) *Attorney, Agent, or Firm* — Pearne & Gordon LLP

(57) ABSTRACT

A refrigerator (1) includes a cabinet (2) provided with a primary electrical circuit (7) connected to a main alternate voltage power supply and at least one movable member (6) associable to the cabinet (2) and provided with a secondary electrical circuit (11). The secondary circuit (11) is powered contactlessly by the primary circuit (7) and the secondary circuit (11) supplies electrical energy to a power consuming device (14).

18 Claims, 5 Drawing Sheets

(51) Int. Cl.

| | |
|---|---|
| *F21Y 101/02* | (2006.01) |
| *F25D 27/00* | (2006.01) |

(56) References Cited

U.S. PATENT DOCUMENTS

| | | | | |
|---|---|---|---|---|
| 4,929,005 | A | | 5/1990 | Heinen et al. |
| 5,070,293 | A | | 12/1991 | Ishii et al. |
| 5,388,796 | A | | 2/1995 | Sullivan |
| 6,016,046 | A | * | 1/2000 | Kaite et al. ..... 320/108 |
| 6,065,821 | A | | 5/2000 | Anderson et al. |
| 6,075,433 | A | | 6/2000 | Ono et al. |
| 6,786,562 | B2 | | 9/2004 | Obrock et al. |
| 6,813,896 | B1 | | 11/2004 | Janke et al. |
| 7,032,408 | B2 | | 4/2006 | Dentella et al. |
| 2003/0090890 | A1 | | 5/2003 | Miozza et al. |
| 2004/0148949 | A1 | | 8/2004 | Parachini et al. |
| 2004/0172964 | A1 | | 9/2004 | Brachert et al. |
| 2006/0156755 | A1 | | 7/2006 | Ouseph et al. |
| 2009/0021927 | A1 | | 1/2009 | Hall et al. |
| 2011/0203302 | A1 | | 8/2011 | Alberghetti et al. |

FOREIGN PATENT DOCUMENTS

| | | | |
|---|---|---|---|
| JP | 2001033136 | | 2/2001 |
| JP | 2001128391 | | 5/2001 |
| JP | 2001128392 | | 5/2001 |
| JP | 2002320348 | * | 10/2002 |
| JP | 2003319573 | | 11/2003 |

* cited by examiner

REFRIGERATOR WITH CONTACTLESSLY POWERED MOVABLE MEMBER

The present invention relates to a refrigerator having one or more movable members which are contactlessly powered for activating a power consuming device.

The term "refrigerator" used herein means refrigerated cabinets in which the temperature is normally higher than 0° C., and freezers in which the temperature is maintained below 0° C., as well as combinations thereof.

It is known that in a refrigerator there is the need of delivering electrical power supply within the refrigerated chambers for powering means like fans, displays or light sources. In current refrigerators such power supply is provided by means of wires electrically connected to the main power that deliver such power to electrical terminals placed within the refrigerated compartments. A drawback of such solution consists in that it cannot guarantee a sufficient level of safety against potentially dangerous electrical power dispersions in the compartments wherein the humidity degree is normally high. Additional risk for the user is caused when such solution is used for delivering electrical power to movable members like food containers, removable shelves or the compartment doors because the user can touch accidentally the electrical contacts left unplugged by the movement of the movable members.

A refrigerator provided with electrically powered shelves is disclosed in the European Patent Application No. EP 1 503 159. In this document it is described a refrigerator comprising a power bus disposed within the refrigerated compartment and electrically connected to a power source. A connector is disposed on the removable shelves. When the removable shelves are mounted within the compartment the connector is connected to the power bus to deliver power to the removable shelves.

The solution described in EP 1 503 159 does not overcome the above mentioned risk of electrical power dispersion within the refrigerated compartment which is a potential source of danger for the user. In addition, the reliability of the connector can be compromised after a number of connection/disconnection cycles as in the case of a refrigerated drawer powered as taught in the cited document.

Another drawback of the solution disclosed in the cited European Patent Application consists in that the shelves can only be placed where a connector is available i.e. only in selected positions. Because of this arrangement, the adjustment of the shelves position within the refrigerated compartment cannot be made continuously along the whole vertical extension of the compartment.

The aim of the present invention is therefore to solve the noted problems, eliminating the drawbacks of the cited known art and thus providing a refrigerator that avoids the risk of electrical power dispersion within the refrigerated compartments.

A further object of the present invention is to provide a refrigerator in which electrical power can be delivered to any movable part associated to the refrigerator cabinet with an improved degree of safety.

Another object of the present invention is to provide a refrigerator having means for delivering electrical power with improved reliability.

Still another object of the invention is to provide a refrigerator easy to be assembled.

Advantages, objects, and features of the invention will be set forth in part in the description which follows and in part will become apparent to those having ordinary skill in the art upon examination of the following or may be learned from practice of the invention. The objects and advantages of the invention may be realised and attained as particularly pointed out in the appended claims.

The accompanying drawings, which are included to provide a further understanding of the invention and are incorporated in and constitute a part of this specification, illustrate possible embodiments of the invention and together with the description serve to explain the principles of the invention.

Figure 1:
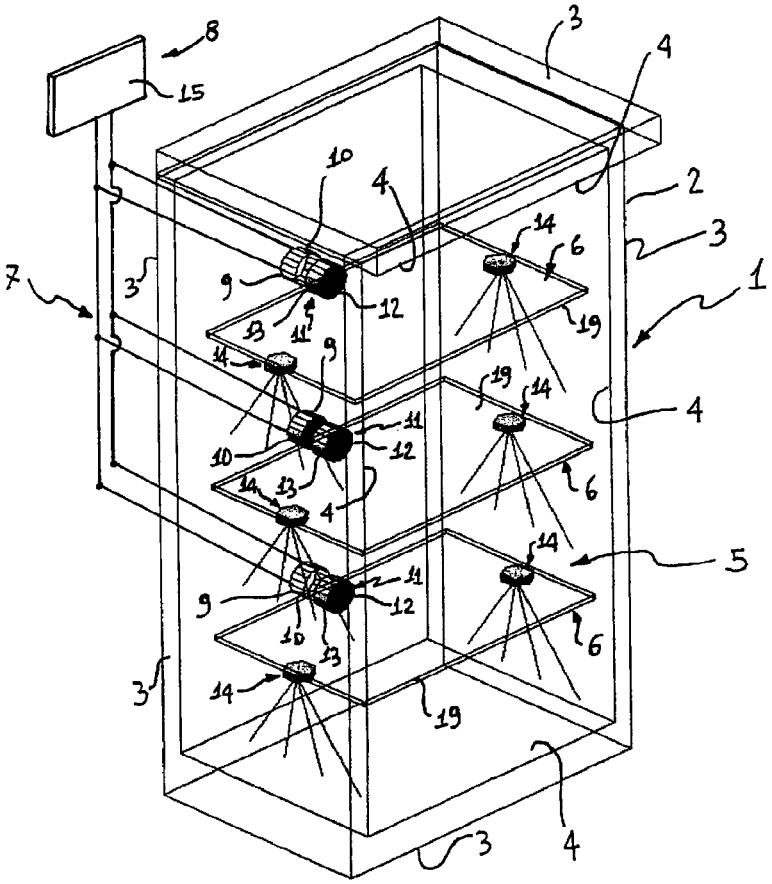
FIG. 1 shows a schematic perspective view of a first embodiment of a refrigerator according to the present invention.

With reference to FIG. 1 a first embodiment of the refrigerator 1 comprises a cabinet 2 having outer walls 3 and inner walls 4 that define a compartment 5 for storing food to be refrigerated or frozen. In FIG. 1 the refrigerator door closing the compartment 5 has been removed to make the drawing clearer. Movable members 6, in the preferred form of shelves 19, are provided within the compartment 5 for dividing it in a plurality of portions. Each shelf 19 can be placed in a plurality of positions in a known manner for arranging the compartment 5 as desired. The cabinet 2 is provided with a primary electrical circuit 7 connected to a main alternate voltage power supply 8 which supplies an electrical power to first inductors 9. Each inductor 9 can comprise a first ferromagnetic element having a first electric coil 10 wrapped around it. Inductors 9 are preferably placed between an outer wall 3 and an inner wall 4 defining a portion of the compartment 5, in this way they are not visible neither from inside the compartment 5 nor from the outside of the cabinet 2.

Each movable member 6 comprises a secondary electrical circuit 11 having a second inductor 12 which preferably comprises a second ferromagnetic element around which a second electrical coil 13 is wrapped. The secondary circuit 11 is contactlessly powered by the primary circuit 7 and such electrical power is supplied to a power consuming device 14 associated to the secondary circuit 11. In FIG. 1 the power consuming devices 14 are in the form of a light emitting unit such as a lamp or a LED, but it can equivalently be provided in the form of motor means or a fan. Motor means can be advantageously used, for example, in an ice-cream machine placed within the compartment 5. Fans can be provided to increase air turbulence within the compartment 5 for obtaining a uniform temperature distribution.

Electrical energy for activating the power consuming devices 14 is contactlessly transferred from the primary circuit 7 to the secondary circuits 11 by means of the first and second inductors 9, 12, facing each other. Said elements 9, 12 form a magnetic circuit interrupted by an air gap due to the refrigerator walls thickness. Therefore the first and second inductors 9, 12 form an electric transformer wherein the secondary circuit 11 is associated to a power consuming device 14.

It can be observed that the best efficiency in the electrical energy transferred contactlessly from the primary circuit 7 to the secondary circuit 11 can be obtained when said magnetic circuit operates at the resonating frequency or at a frequency very close to it. For this reason it is preferred that the main alternate voltage power supply 8 comprises an oscillating circuit 15 able to supply the power needed at a pre-set frequency which is said resonating frequency.

Power consuming devices 14 may be removably associated to a movable member 6 or it may be incorporated in the member 6 itself. In the first case suitable connecting means will be provided on the members 6 and on the devices 14 for allowing electrical connection between the secondary circuit 11 and the device 14, while in the second case the device 14 can be incorporated in the member 6 together with the secondary circuit 11.

Figure 2:
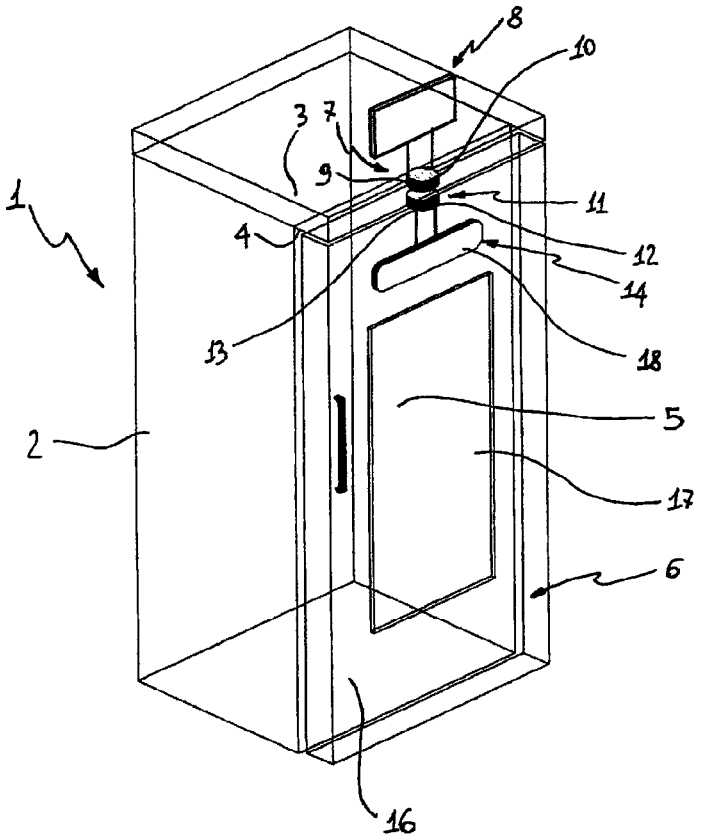
FIG. 2 shows a schematic perspective view of a second embodiment of a refrigerator according to the present invention.

In FIG. 2 a second embodiment of the refrigerator 1 is shown. In such embodiment a primary electrical circuit 7 connected to a main alternate voltage power supply 8 comprises a first inductor 9 preferably comprising a first ferromagnetic element having a first electric coil 10 wrapped around it. Said inductor 9 is placed between an outer wall 3 of the cabinet 2 and an inner wall 4 defining a surface of a compartment 5 enclosable by a movable member 6 in the form of a door 16. On an upper edge of the door 16 it is provided a secondary electrical circuit 11 comprising a second inductor 12 preferably having a second ferromagnetic element around which an electrical coil 13 is wrapped. The second inductor 12 faces the first inductor 9 such that when the door 16 is in a closed position an electrical power can be contactlessly transferred from the primary circuit 7 to the secondary 11. In this way a power consuming device 14, such as a LED panel 18, in electrical contact with the secondary circuit 11 can be powered. A window 17 provided on the outer surface of the door 16 allows the user to look into the compartment 5 illuminated by the LED 18.

Figure 3:
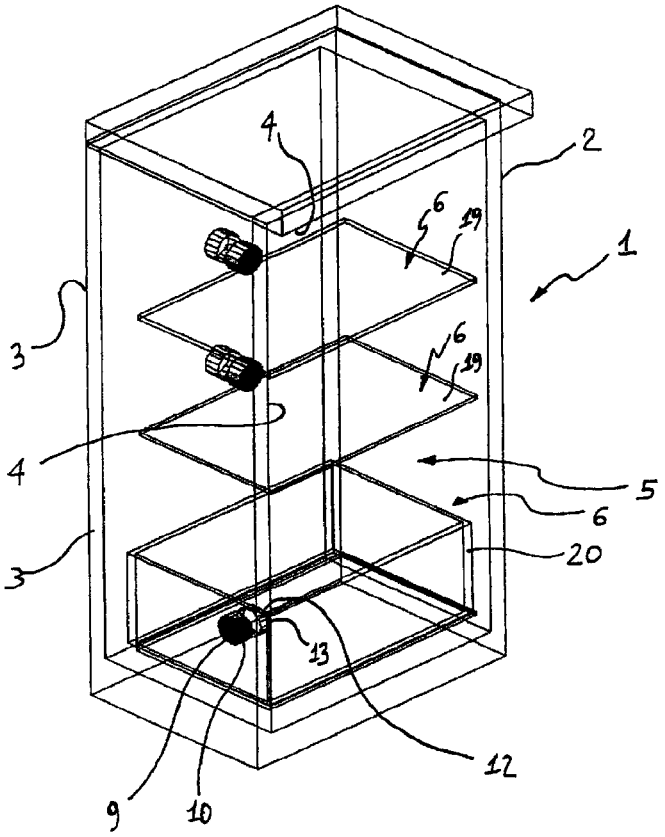
FIG. 3 shows a schematic perspective view of a possible arrangement for the first and second inductors in a refrigerator having movable members of different type.

In FIG. 3 it is schematically shown a refrigerator 1 with a possible arrangement for the first and second inductors 9, 12 when the movable members 6 are in the form of shelves 19 and in the form of a drawer 20. In FIG. 3 the refrigerator door, the power consumption devices 14 and the primary and secondary circuits 7, 11 have been omitted. The arrangement of the inductors 9, 12 in order to transfer electrical power form the refrigerator cabinet 2 to the movable shelves 19 has been already described with reference to FIG. 1. In case of the drawer 20 the first inductor 9, having preferably a first ferromagnetic element carrying a first coil 10, is placed between an outer wall 3 of the cabinet 2 and an inner wall 4 defining a surface of a compartment 5. The second inductor 12 having a second ferromagnetic element carrying the second coil 13 is associated to the drawer 20 in a position facing the first inductor 9 when the drawer is completely inserted within the compartment 5. In this position electrical energy can be contactlessly transferred from the cabinet 2 to the drawer 20. Such power supply can be used to activate a fan (not shown) only when the drawer 20 is completely inside the compartment 5 thereby creating an air circulation in the drawer 20.

In FIGS. 1 and 3, shelves 19 can be contactlessly powered only when they are placed in particular pre-defined positions, that is in the positions corresponding to the displacement of the first inductors 9 which are fixed to the refrigerator 1. Since the user may desire to move the shelves continuously along the vertical direction of the compartment 5, a particular design for the first and second inductor has been provided. Such design is shown in FIGS. 4 and 5 where primary and secondary circuits and are not shown.

Figure 4:
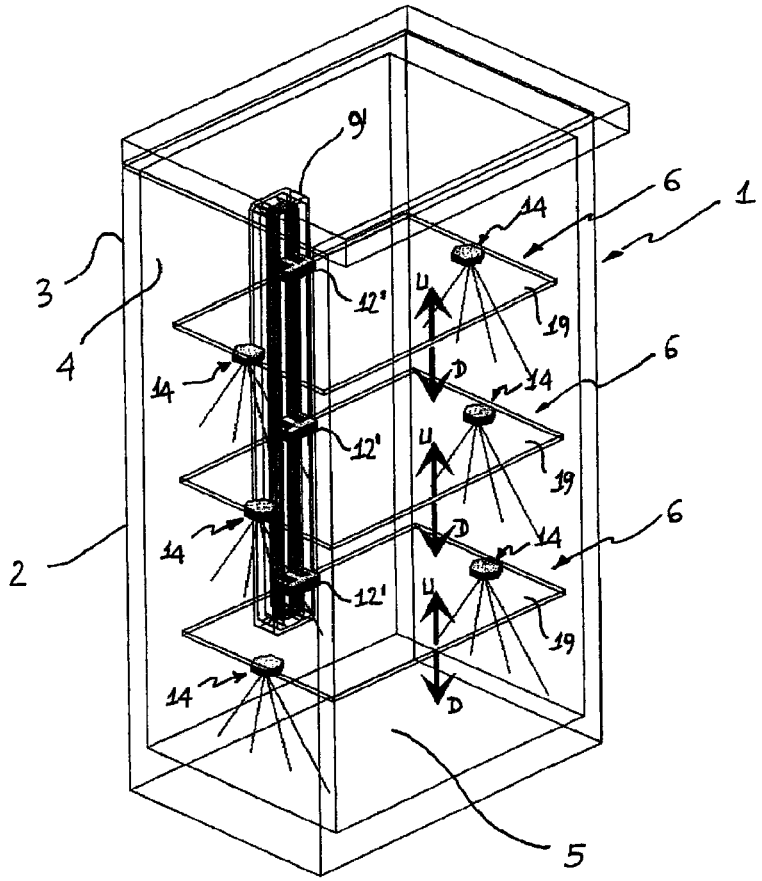
FIG. 4 shows a schematic perspective view of the refrigerator shown in FIG. 1 having a first inductor extending vertically within a compartment and a second inductor coupled to it.

In FIG. 4 a refrigerator 1 is provided on its back, in a region between an outer wall 3 of the cabinet 2 and an inner wall 4 of the compartment 5, with a first inductor 9' that extends vertically within the compartment 5. As better shown in the schematic enlarged view of FIG. 5, the first inductor 9' is formed by an elongated-loop winding made of conductive material (e.g. enameled copper) that generates a magnetic field having an elongated shape when powered. Shelves 19 are associated to a second inductor 12' having three spaced apart arms 21 protruding from a transversal bar 23 and preferably comprising a ferromagnetic element having an electric coil wrapped around it. Said arms 21 define two slots 22 adapted to receive a portion of the first inductor 12' such that electrical power can be contactlessly transferred from the primary circuit connected with the first inductor 9' to the secondary circuit associated to the second inductor 12'.

Figure 5:
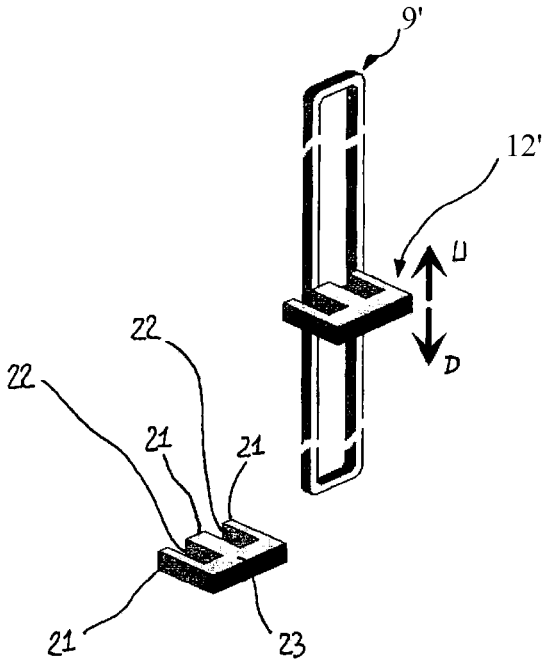
FIG. 5 shows a schematic perspective and enlarged view of the first and second inductors shown in FIG. 4.

Thanks to the arrangement shown in FIGS. 4 and 5 each shelf 19 can be independently moved upward or downward as shown by the arrows "U" and "D". These movements can also be supplied by motor means, associated to the shelves 19, advantageously powered by the secondary circuit. Further power consuming devices 14, such as light emitting units, can be incorporated or removably associated to the shelves.

Conclusively it can be stated that a refrigerator 1 according to the present invention has an improved degree of safety because no connector is needed for powering movable members associated to the refrigerator cabinet. The proposed solution is also advantageous because it simplifies the assembly of the refrigerator reducing the number of parts needed.

As the present invention may be embodied in several forms without departing from the spirit or essential characteristics thereof, it should also be understood that the above-described embodiments are not limited by any of the details of the foregoing description, but rather should be construed broadly within its spirit and scope as defined in the appended claims, and therefore all changes and modifications that fall within the meets and bounds of the claims, or equivalence of such meets and bounds are therefore intended to be embraced by the appended claims.

What is claimed is:

1. A refrigerator (1) comprising:

a cabinet (2) having outer walls (3) and inner walls (4) defining a compartment (5), and a door for closing the compartment (5), the cabinet (2) being provided with a primary electrical circuit (7) connected to a main alternate voltage power supply (8) and supplying electrical power to at least one first inductor (9, 9') placed between one of the outer walls (3) and one of the inner walls (4) of the compartment (5); and at least one movable member (6) associable to the cabinet (2) so as to be entirely received within said compartment and movable in a plurality of operative positions vertically inside said compartment (5), the movable member (6) being provided with a secondary electrical circuit (11) comprising a second inductor (12, 12'), wherein the secondary electrical circuit (11) is powered contactlessly by the primary electrical circuit (7) and the secondary electrical circuit (11) supplies electrical energy to a power consuming device (14) associated with the secondary electrical circuit (11), wherein along a line from an interior of the cabinet (2) to an exterior of the cabinet (2) and perpendicular to one of the outer walls (3), the cabinet (2) has a single one of the outer walls (3) and a single one of the inner walls (4) and the first inductor (9, 9') is positioned between the single one of the outer walls (3) and the single one of the inner walls (4) and is fixed to the single one of the inner walls (4), and wherein the first inductor (9, 9') extends vertically as an elongated loop for generating an elongated magnetic field along a vertical length of the single one of the inner walls (4) when said movable member (6) is housed inside the compartment (5) in any operative position along a vertical length of the first inductor (9, 9'), wherein the first inductor (9, 9') and the second inductor (12, 12') are located on opposite sides of the single one of the inner walls (4) of the compartment (5) in a way that the first inductor (9, 9') and the second inductor (12, 12') face each other.

2. A refrigerator (1) according to claim 1, wherein the first inductor (9) comprises a first electric coil (10) wrapped around a first ferromagnetic element.

3. A refrigerator (1) according to claim 1, wherein the second inductor (12, 12') comprises an electrical coil (13) wrapped around a second ferromagnetic element.

4. A refrigerator (1) according to claim 1, wherein the first inductor (9, 9') and the second inductor (12, 12') are located on opposite sides of one of the inner walls (4) in a way that the first inductor (9, 9') and the second inductor (12, 12') face each other.

5. A refrigerator (1) according to claim 1, wherein the first inductor (9') extends vertically as an elongated loop along one of the inner walls (4) of the compartment (5), wherein the first inductor (9, 9') and the second inductor (12, 12') are facing each other.

6. A refrigerator (1) according to claim 5, further comprising a tertiary electrical circuit comprising a third inductor powered contactlessly by the primary electrical circuit and the tertiary electrical circuit supplies electrical energy to a further power consuming device associated with the tertiary electrical circuit.

7. A refrigerator (1) according to claim 1, wherein the movable member (6) is a food supporting device.

8. A refrigerator (1) according to claim 1, wherein the movable member (6) is a shelf (19).

9. A refrigerator (1) according to claim 8, wherein the movable member (6) can be vertically adjusted within the compartment (5).

10. A refrigerator (1) according to claim 1, wherein the movable member (6) is a drawer (20).

11. A refrigerator (1) according to claim 1, wherein the power consuming device (14) is a motor.

12. A refrigerator (1) according to claim 1, wherein the power consuming device (14) is a light emitting unit (18).

13. A refrigerator (1) according to claim 1, wherein the power consuming device (14) is a fan.

14. A refrigerator (1) according to claim 1, wherein the power consuming device (14) is removably associated to the movable member (6).

15. A refrigerator (1) according to claim 1, wherein the second inductor (12, 12') has three spaced apart arms (21) protruding from a transversal bar (23), said arms (21) defining two slots (22) adapted to receive a portion of the first inductor (9, 9').

16. A refrigerator (1) comprising:

a cabinet (2) having outer walls (3) that form an exterior of the cabinet (5) and inner walls (4) that form boundaries of a compartment (5), and a door for closing the compartment (5), the cabinet (2) being provided with a primary electrical circuit (7) connected to a main alternate voltage power supply (8), the primary electrical circuit (7) comprising a first inductor (9') located outside said inner walls (4); and at least one movable member (6) received within the inner walls (4) and movable in a plurality of operative positions vertically inside said compartment (5), said member (6) being provided with a secondary electrical circuit (11) comprising a second inductor (12') coupled to the first inductor (9'), wherein said secondary circuit (11) is powered contactlessly by said primary electrical circuit (7) and supplies electrical energy to a power consuming device (14) associated with the secondary electrical circuit (11), wherein along a line from an interior of the cabinet (2) to an exterior of the cabinet (2) and perpendicular to one of the outer walls (3), the cabinet (2) has a single one of the outer walls (3) and a single one of the inner walls (4) and the first inductor (9') is positioned between the single one of the outer walls (3) and the single one of the inner walls (4) and is fixed to the single one of the inner walls (4), and wherein the first inductor (9') extends vertically as an elongated loop for generating an elongated magnetic field along a vertical length of the single one of the inner walls (4) when said movable member (6) is housed inside the compartment (5) in any operative position along a vertical length of the first inductor (9'), wherein the first inductor (9') and the second inductor (12') are located on opposite sides of the single one of the inner walls (4) in a way that the first inductor (9') and the second inductor (12') face each other.

17. A refrigerator comprising:

a cabinet (2) having outer walls (3) and inner walls (4), said inner walls (4) defining a compartment (5) for storing food, said cabinet (2) having a primary electrical circuit (7) connected to a main alternative voltage power supply (8) which supplies electrical power to at least one first inductor (9), wherein the first inductor (9) is installed between the outer walls (3) and the inner walls (4) in such a way that the first inductor (9) is not visible from inside the compartment (5) and from outside the cabinet (2);

a plurality of movable members (6) dividing the compartment (5) in a plurality of portions, wherein each of the movable members (6) is movable in a plurality of operative positions vertically inside said compartment (5) and wherein each of the movable members (6) comprises a secondary electrical circuit (11) having a second inductor (12), said first inductor (9) and said second inductor (12) being installed facing each other and forming an electric transformer, wherein the secondary circuit (11) is contactlessly powered by the primary circuit (7) by way of a magnetic circuit formed by the first inductor (9) and the second inductor (12), said secondary circuit (11) supplying electrical power to at least one power consuming device (14) connected to the secondary circuit (11), wherein along a line from an interior of the cabinet (2) to an exterior of the cabinet (2) and perpendicular to one of the outer walls (3), the cabinet (2) has a single one of the outer walls (3) and a single one of the inner walls (4) and the first inductor (9) is positioned between the single one of the outer walls (3) and the single one of the inner walls (4) and is fixed to the single one of the inner walls (4), and wherein the first inductor (9) extends vertically as an elongated loop for generating an elongated magnetic field along a vertical length of the single one of the inner walls (4) when each of the movable members (6) is housed inside the compartment (5) in any operative position along a vertical length of the first inductor (9), wherein the first inductor (9) and the second inductor (12) are located on opposite sides of the single one of the inner walls (4) in a way that the first inductor (9) and the second inductor (12) face each other.

18. A refrigerator (1) comprising:

a cabinet (2) having outer walls (3) and inner walls (4) defining a compartment (5), and a door for closing the compartment (5), the cabinet (2) being provided with a primary electrical circuit (7) connected to a main alternate voltage power supply (8) and supplying electrical power to at least one first inductor (9, 9') placed between one of the outer walls (3) and one of the inner walls (4) of the compartment (5); and at least one movable member (6) associable to the cabinet (2) so as to be entirely received within said compartment and movable in a plurality of operative positions vertically inside said compartment (5), the movable member (6) being provided with a secondary electrical circuit (11) comprising a second inductor (12, 12'), wherein the secondary electrical circuit (11) is powered contactlessly by the primary electrical circuit (7) and the secondary electrical circuit (11) supplies electrical energy to a power consuming device (14) associated with the secondary electrical circuit (11), and wherein the first inductor (9, 9') extends vertically as an elongated loop for generating an elongated magnetic field along a vertical length of one of the inner walls (4) of the compartment (5) when said movable member (6) is housed inside the compartment (5) in any operative position along a vertical length of the first inductor (9, 9'), wherein the first inductor (9, 9') and the second inductor (12, 12') are located on opposite sides of one of the inner walls (4) of the compartment (5) in a way that the first inductor (9, 9') and the second inductor (12, 12') face each other.

* * * * *